US005483886A

United States Patent [19]

Hauer

[11] Patent Number: 5,483,886

[45] Date of Patent: Jan. 16, 1996

[54] PAPER GUIDE FOR WEB-FED PRESS

[75] Inventor: Horst-Walter Hauer, Würzburg, Germany

[73] Assignee: Koenig & Bauer Aktiengesellschaft, Wurzburg, Germany

[21] Appl. No.: 395,152

[22] Filed: Feb. 27, 1995

Related U.S. Application Data

[63] Continuation of Ser. No. 113,095, Aug. 30, 1993, abandoned.

[30] Foreign Application Priority Data

Aug. 28, 1992 [DE] Germany ..... 42 28 611.5

[51] Int. Cl.[6] ..... B41F 5/18

[52] U.S. Cl. ..... 101/181; 101/120; 101/424.1

[58] Field of Search ..... 101/179, 180, 101/181, 182, 219, 220, 221, 222, 416.1, 417, 418, 424.1

[56] References Cited

U.S. PATENT DOCUMENTS

| | | | |
|---|---|---|---|
| 971,534 | 10/1910 | Firm | 101/222 |
| 1,738,324 | 12/1929 | Scott | 101/222 |
| 1,973,034 | 9/1934 | Ball . | |
| 2,076,932 | 4/1937 | Barber | 101/179 |
| 2,112,586 | 4/1937 | Barber | 101/179 |
| 2,649,044 | 7/1948 | Dungler . | |
| 3,160,094 | 12/1964 | Bean | 101/181 |
| 4,218,973 | 8/1980 | Bouffard et al. | 101/181 |
| 4,412,490 | 11/1983 | Grosshauser | 101/180 |
| 4,480,543 | 11/1984 | Hechler | 101/181 |
| 4,993,320 | 2/1991 | Kochsmeier . | |
| 5,179,899 | 1/1993 | Burger et al. | 101/221 |

FOREIGN PATENT DOCUMENTS

| | | | |
|---|---|---|---|
| 0287002 | 10/1988 | European Pat. Off. . | |
| 0350434 | 1/1990 | European Pat. Off. . | |
| 3535993 | 4/1987 | Germany . | |
| 0137968 | 10/1981 | Japan | 101/222 |
| 1348158 | 3/1974 | United Kingdom . | |
| 1394241 | 5/1975 | United Kingdom . | |
| 1559783 | 1/1980 | United Kingdom . | |
| 2038450 | 7/1980 | United Kingdom . | |
| 2266516 | 11/1993 | United Kingdom . | |
| WO9003323 | 4/1990 | WIPO . | |

*Primary Examiner*—Edgar S. Burr
*Assistant Examiner*—Lynn D. Hendrickson
*Attorney, Agent, or Firm*—Jones, Tullar & Cooper

[57] ABSTRACT

A paper guide for a web-fed rotary printing press with multiple color printing groups on several vertically spaced levels provides a path for the freshly printed multiple color web to air dry as it travels along the machine frame. The length of travel of the air drying path is a multiple of the spacing between adjacent plate cylinders in any of the levels in the printing machine.

4 Claims, 1 Drawing Sheet

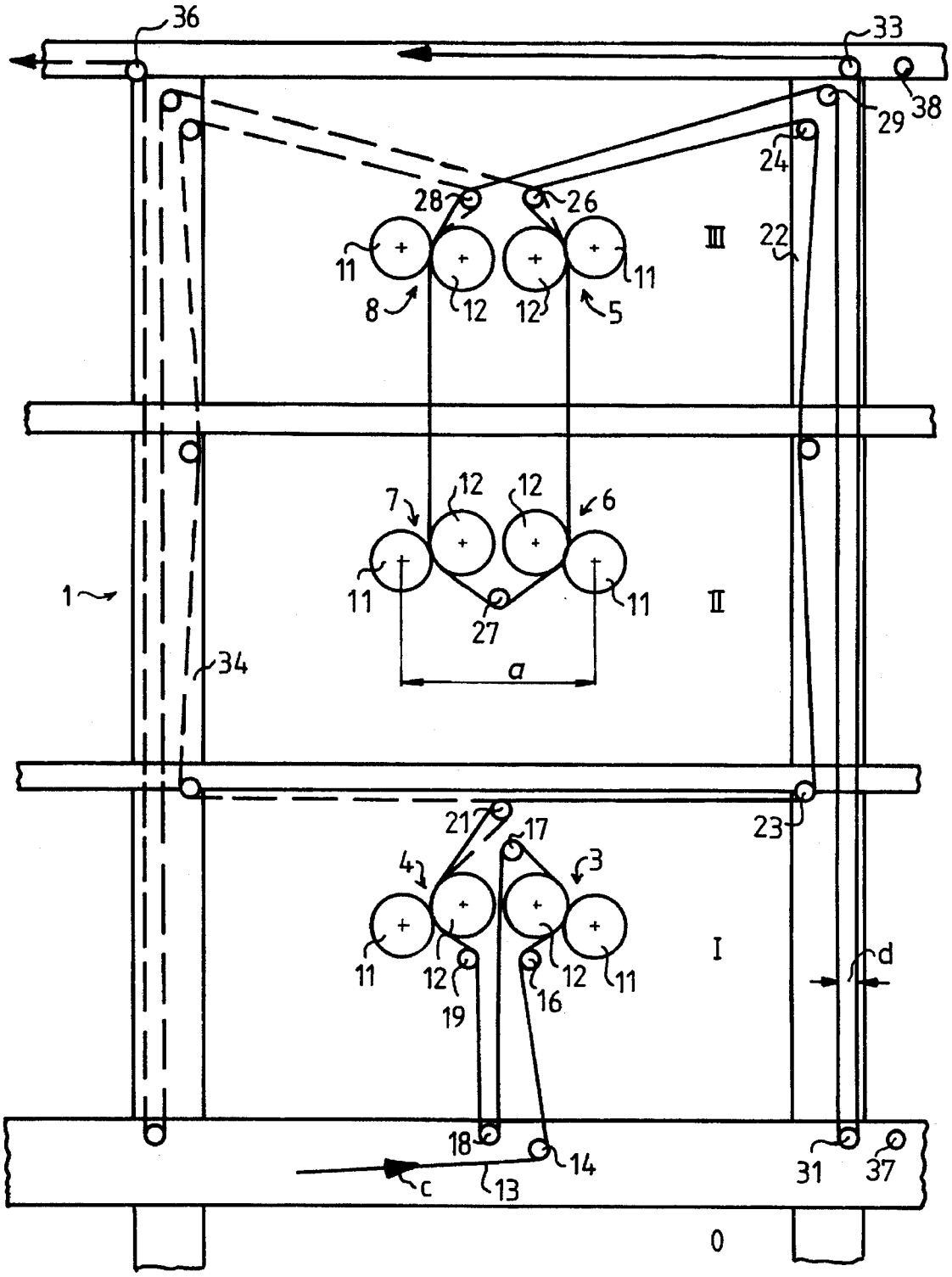
36
33
38
29
24
28
26
III
22
11
11
8
12
12
5
7
12
12
6
1
11
11
II
27
34
a
21
17
23
4
3
I
11
12
12
11
d
19
16
18
14
31
37
c
13
0

PAPER GUIDE FOR WEB-FED PRESS

This application is a continuation, of application Ser. No. 08/113,095, filed Aug. 30, 1993 now abandoned.

FIELD OF THE INVENTION

The present invention is directed generally to a paper guide for a web-fed printing press. More particularly, the present invention is directed to a paper guide for a web-fed rotary printing press. Most specifically, the present invention is directed to a paper guide for a web-fed multiple color rotary printing press. The paper web guide is usable to provide a paper web travel path having sufficient length so that a web of coated paper, which has been printed on one side in a plurality of colors, will be dry before the multiple color printed side of the web is brought into contact with a possible ink smearing surface, such as a guide roller. The length of the paper web travel path is a function of the number of colors being printed and the size of the printing cylinders.

DESCRIPTION OF THE PRIOR ART

It is generally known in tile art to use flexographic inks, which are water based inks, in the printing of newspapers and the like in web-fed rotary printing presses. The German Patent Disclosure DE 35 35 993 A1 is one example of a prior teaching of the use of these kinds of water based inks. In the prior art, these water based inks were typically used to print on uncoated or natural paper. Such paper is relatively absorbent so that black inks as well as various other colors of inks could be used in printing multi-colored products such as newspapers without the need for a lengthy ink drying path or procedure. In the printing of these uncoated or natural papers using water based inks, it was not necessary to utilize other than the generally conventional air-drying process to suitably dry the inks prior to the printed web being further handled or manipulated without fear of the ink being smeared.

In an effort to attain a higher image quality, the trend has been to the use of so-called "coated paper" which lends more color brilliance to the printed product, such as a multi-colored daily newspaper. This means that the drying process must be improved or accelerated to avoid smearing of the fresh ink on the coated paper. There is little space available in present printing machines for the addition of large drying systems. The effective result is that the production speed of the printing press must be reduced to a speed such that the multiple colored printed coated paper will have adequate time to dry before it comes into contact with a possibly ink smearing device, such as a turning bar, a guide roller, or the like.

It will thus be seen that a need exists for a paper web guide which provides sufficient drying time for multiple colored printing webs of coated or uncoated paper. The paper guide for a web-fed press in accordance with the present invention provides such a device and is a significant advance in the art.

SUMMARY OF THE INVENTION

It is an object of the present invention to provide a paper guide for a web-fed press.

Another object of the present invention is to provide a paper guide for a web-fed rotary printing press.

A further object of the present invention is to provide a paper web guide for a web-fed multiple color printing press.

Still another object of the present invention is to provide a paper guide for a web fed, press which uses a plurality of water based inks, Yet a further objector the present invention is to provide a paper web guide for a web-fed press that prints in multiple colors using water based inks on a coated web.

Even still another object of the present invention is to provide a paper web guide for a web fed printing press in which the distance of travel of the freshly printed web is a function of the size of the printing cylinders and the number of colors being printed.

As will be discussed in detail in the description of the preferred embodiment which is set forth subsequently, the paper guide for web-fed printing presses in accordance with the present invention utilizes several printing couples on three vertically spaced levels of a printing apparatus. A first, lower level prints either one or both sides of a paper web in black ink. The partially printed web then is guided up to the upper portion of the third, uppermost level, where it then is printed on one side in the upper two levels by as many as four printing couples in four different colors. After the fourth or final color has been applied to the web, it is guided from the upper portion of the upper level to the lower portion of the lower level without the first multiple color printed image being contacted by any guide rollers or the like. The distance which the multiple color printed web travels before it contacts a guide roller or turning bar on its freshly printed surface is determined by multiplying the spacing distance between the axis of rotation of the two plate cylinders in the printing groups in each level by the number of different being used in the printing of the web. An additional distance of web travel can be utilized if it is important that the multiple color printed web be completely free of even the smallest smear color distortions.

By providing a paper web guide path whose length is a function of the spacing of the plate cylinders and the number of different colors being printed, it will be possible to air-dry the freshly printed web, even when the substrate being printed is the so-called "coated paper". There is no need to provide additional drying devices such as forced air ventilators or heaters. Since the guide rollers do not immediately come into contact with the freshly printed, multiple-color web, a smear-free, brilliant color printing on the coated paper is attained. The paper guide assembly of the present invention provides a sufficiently long path of travel for the printed web so that the web will dry completely. This allows the production speed of the printing press to be increased so that it corresponds with a press speed that would be used with uncoated paper. Either coated or uncoated paper can be printed without the need for changing in accordance with the type of paper being used.

The paper guide for web-fed multiple color printing presses in accordance with the present invention overcomes the limitations of the prior art devices. It provides a substantial advance in the art.

BRIEF DESCRIPTION OF THE DRAWINGS

While the novel features of the paper guide for web-fed printing presses are set forth with particularity in the appended claims, a full and complete understanding of the invention may be had by referring to the detailed description of the preferred embodiment which is set forth subsequently, and as illustrated in the sole drawing figure which is a schematic side elevation view of a web-fed rotary printing press in accordance with the present invention.

DESCRIPTION OF THE PREFERRED EMBODIMENT

Referring to the sole drawing figure, there may be seen a preferred embodiment of a paper guide for a web-fed press. A web-fed rotary printing machine, which is usable to print a multiplicity of different colors of ink onto a web of coated or uncoated paper is shown generally at 1 in the drawing. A total of six printing groups, 3–8, are disposed in the printing machine. Printing groups 3 and 4 occupy a first, lower level I; printing groups 6 and 7 occupy a second, intermediate level II; and printing groups 5 and 8 occupy a third, upper level III. Each of these printing groups is supported between spaced side frames of the printing machine 1, in a generally well known manner. The printing groups themselves are also generally conventional in operation. Each printing group 3–8 includes a plate cylinder 11 which carries at least one generally soft, flexible letter press printing plate, which is not specifically shown in the sole drawing figure. A counterpressure cylinder 12, that is constructed of a hard metal, cooperates with the plate cylinder 11 in each of the printing groups 3–8. Each plate cylinder 11 further cooperates with a suitable screen roller that is not specifically shown and which receives printing ink from a chambered doctor blade and transfers this ink to the plate cylinder 11. Since these screen rollers, and chambered doctor blades are generally conventional and form no part of the present invention, they are not shown in the drawings.

The lower level printing groups 3 and 4 are used to apply black ink to a paper web 13 which is fed into the lower level I in the direction indicated by arrow C. The printing groups 5–8 in the intermediate and upper levels II and III, respectively, are used to apply multiple different colors to the web 13. The paper web 13 is fed to the printing machine 1 from a suitable reel stand or reel star and travels along a sub-level or plane O, such as the substructure of the web fed rotary printing press. As may be seen in the sole drawing figure, a spacing "a" is he distance between the two axes of rotation of the plate cylinders 11 in each of the two printing groups in each of the three vertically spaced levels.

The paper web 13 to be printed in multiple colors in the printing machine 1 enters the machine from the sub-level 0 in the direction indicated by arrow c and passes around guide rollers 14 and 16 and then passes between the plate cylinder 11 and the counterpressure cylinder 12 of the first printing group 3. This first printing group 3 on the lower level I prints one side of the paper web 13 with a black ink. After having been printed in black on one side, the web 13 is reversed in direction by passing around guide roller 17 and is guided vertically downwardly from an upper portion of the lower level I to a lower portion of the lower level I where it passes around guide roller 18. The web 13 can then be directed up around guide roller 19 and can be passed between the second lower level printing group 4 where the printing cylinder 11 and the counterpressure cylinder 12 can be used to print in black on the second side of the web 13. If desired, the second lower level printing group 4 can be eliminated or can be used to print a different color on the second side of the paper web 13. If the second lower level printing group 4 is not used on the web 13 as a color printing group, the web 13 is subsequently provided with 4/0 color printing. As is understood in the art, this means that one side of the web will receive four colors of ink while the other side of the web will receive no color ink.

After paper web 13 has been printed on one or both sides with black ink in the printing groups 3 and 4 of the lower level I, the web 13 is guided horizontally across the upper portion of the lower level I to a first vertically extending support column 22 which forms a portion of the frame of the printing machine 1. A first guide roller 21 that is positioned above the printing couples 3 and 4 of the lower level I directs the web 13 to a guide roller 23 secured to the first support column 22 at the upper portion of the lower level I. The web then travels vertically upwardly along column 22 to a guide roller 24 at the upper portion of the upper level III. The web 13 then is directed in to a guide roller 26 which is placed above the first printing group 5 for colored ink in the upper level III. As may be seen in the sole drawing figure, the web 13 then passes down through the printing groups 5 and 6 on the upper and intermediate levels III and II respectively; around a guide roller 27 positioned beneath the two printing groups 6 and 7 on the intermediate level II; and back up through the printing groups 7 and 8 on the intermediate and upper levels II and III; respectively.

As the web 13 passes through the four color printing groups 5, 6, 7, and 8, one of its sides is printed subsequently in the four different colors that are applied by the four printing groups. Once the web 13 emerges from the fourth color printing group 8 on the upper level III, it is passed around a guide roller 28 that is situated above the printing group 8. During the travel through these four color printing groups 5–8 and their associated guide rollers 26, 27, and 28, only the unprinted or black ink only printed side of the web 13 is in contact with the guide rollers 26, 27, and 28 and the counterpressure cylinders 12. The paper web 13 which has now been printed in this manner with a 4/0 color printing, travels from the guide roller 28 generally horizontally across generally one half of the upper portion of the upper level III of the printing machine 1 to a guide roller 29 which is secured to the upper end of the first support columns 22 generally adjacent and outside of the guide roller 24 which supports the web 13 before it passes through any of the color printing groups 5–8. The paper web 13 is then directed vertically down three levels to a guide roller 31 at the bottom Of the first support column 22. This is the first point at which the multi-color printed side of the web 13 is in contact with a guide roller subsequent to its exit from the last color printing group 8. The paper web 13 then travels upwardly again to the top of the support column 22 to a guide roller 33 that is adjacent and outboard from guide rollers 24 and 29. The paper web 13, on which the multi-color printing is now completely dry, can be directed from roller 33 horizontally across the printing machine 1 to a suitable folder or the like which is not specifically shown in the drawings.

If desired, the guide roller 31 can be provided as a paper web reversing device in the form of a web-turning bar or bars that can be provided with an air cushion. The paper web 13 will travel from the fourth or last color printing group 8 across half the width of the printing machine 1 and down three levels before its multiple color printed side contacts the roller 31. Thus the web 13 will pass through an air drying segment of substantial length. If desired, the guide roller 31 could be relocated on the support column 22 at the upper portion of the lower level I next to the guide roller 23. This placement would be appropriate if the multiple color printed web did not need as long a travel path to effect air drying. It would also be possible to increase a spacing "d" between the downward and upward travel paths of the multiple color printed web 13 along support column 22 by running the web 13 horizontally to an outwardly located roller 37 at the bottom of the lower level I and then up to the most outwardly spaced guide roller 38 at the upper end of the support column 22. Once the web had passed around this guide roller 38, it could then travel across roller 33 and horizontally across the upper portion of the upper level III to the folding device.

Referring again to the sole drawing figure, it would also be possible to direct the paper web 13, once it has been printed in black only by the first and second printing groups 3 and 4 around the guide roller 21 and along a second support column 34 of the printing machine along a path depicted in dashed lines in the drawing. This would mean that the paper web 13 would pass through the color printing groups in inverse order; i.e. through groups 8, 7, 6 and 5 and would then be air dried as it traveled across half the width of the machine land down along the second support column 34. This would result in an 0/4 color printing production on the web 13 as opposed to the 4/0 color printing production as the web 13 travels along the path shown in solid lines in the drawing figure.

All of the various guide rollers which are secured to the printing machine are securely attached to the machine's housing. They have surfaces which are made of a water repelling material, such as a plastic, for example TEFLON. The printing machine 1 which includes the various printing groups, rollers and the like can be used in concert with other similar printing machines with pairs of these machines being situated next to, or above each The path of travel of the paper web 3 through the various color printing groups 5–8 is, as was discussed above, effected in a manner such that the freshly printed, multiple colored side of the web 13 does not come into contact with the guide rollers 27, 28, or 29. The distance of the drying path of the freshly multiple colored printed web 13 is thus the distance between the exit point of the web from the fourth or last color printing group 8 to the guide roller or paper reversing roller 31, which may be located at the lower portion of the lower level I. Assuming that the number of different color printing inks, other than black, being applied to the web 13 is represented by n, the minimum travel path of the web 13 from the last color printing group 8 to the first printed side contacting roller, such as roller 31 is at least (n+1) times the horizontal distance "a" between the axis of rotation of the two adjacent plate cylinders 11 in each of the several levels I, II, and III. This distance can be increased to (n+2) or (n+3) times "a". Clearly as the number (n+1) increases to (n+2) and to (n+3) the assurance of obtaining absolutely smear free printing also increases. In a normal situation in which the web 13 is printed in four colors by the four color printing groups 5, 6, 7 and 8, and using (n+2), the travel distance between the last printing group 8 and the first web reversing roller 31 will be a total of six times the dimension "a". If only two color inks are being applied to the web 13, the minimum drying distance can be reduced to (n+2) or four times the distance "a" which again is the horizontal distance between the axes of rotation of the two adjacent plate cylinders 11 in each of the three printing levels I, II, and III. If the distance is increased to (n+3) times "a" an absolutely smear free printing of the paper web 13 will be assured. In a typical printing machine, the distance "a" may be about 1.15 meters.

While a preferred embodiment of a paper guide assembly for a web-fed multiple color printing press in accordance with the present invention has been set forth fully and completely hereinabove, it will be apparent to one of skill in the art that a number of changes in, for example, the overall size of the printing machine, the supports and drives for the printing groups, the supports for the guide rollers and the like could be made without departing from the true spirit and scope of the present invention which is accordingly to be limited only by the following claims.

I claim:

1. A paper guide assembly for a web-fed rotary printing press, said paper guide assembly comprising:

a plurality of colored ink printing groups arranged in pairs of printing groups in each of multiple levels of a printing machine, each of said colored ink printing groups having a plate cylinder and a corresponding counter pressure cylinder, said plate cylinders in each of said pairs of colored ink printing groups in each of said levels being spaced a distance "a" from each other, said plurality of colored ink printing groups having a total of "n" colors of water-based ink;

means for passing a selectably coated or uncoated web to be printed in said "n" colors on a first side through said pairs of colored ink printing groups to print said first side of said web in said "n" colors; and a printed paper web side air-drying path between a last one of said colored ink printing groups and a first paper reversing device contacting said printed first side of said selectably coated or uncoated web, said printed web side air-drying path receiving said printed web printed in said "n" colors from said last one of said colored ink printing groups and having an air-drying path length of at least (n+1) times said distance "a" to thereby permit complete air-drying of said selectably coated or uncoated printed web.

2. The paper guide assembly of claim 1 further including a plurality of paper web guide rollers in said printing machine, said paper web guide rollers having ink repelling surfaces.

3. The paper guide assembly of claim 2 wherein said surfaces of said guide rollers are plastic.

4. The paper guide assembly of claim 1 wherein said pairs of printing groups are arranged in vertical levels in said printing machine and further wherein said means for passing a web through said printing groups includes a plurality of guide elements.

* * * * *